US006762782B2

(12) United States Patent
Mindler et al.

(10) Patent No.: US 6,762,782 B2
(45) Date of Patent: Jul. 13, 2004

(54) METHOD AND APPARATUS FOR REDUCING UNEVEN USE OF HEATING ELEMENTS ON THERMAL PRINT HEAD

(75) Inventors: Robert F. Mindler, Churchville, NY (US); Charles S. Christ, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 91 days.

(21) Appl. No.: 10/268,814

(22) Filed: Oct. 10, 2002

(65) Prior Publication Data

US 2004/0070635 A1 Apr. 15, 2004

(51) Int. Cl.[7] ..... B41J 2/37; B41J 2/35

(52) U.S. Cl. ..... 347/188; 347/211

(58) Field of Search ..... 347/188, 182, 347/189, 183, 190, 191, 180, 193, 195, 211; 400/120.09, 120.1, 120.11, 120.13, 120.15, 120.05

(56) References Cited

U.S. PATENT DOCUMENTS 4,587,530 A * 5/1986 Noguchi ..... 347/195
4,745,413 A 5/1988 Brownstein et al. ..... 347/182
5,132,701 A * 7/1992 Stephenson et al. ..... 347/176
5,438,352 A * 8/1995 Agano ..... 347/183
5,451,985 A * 9/1995 Cho ..... 347/183

* cited by examiner

*Primary Examiner*—K. Feggins
(74) *Attorney, Agent, or Firm*—Roger A. Fields

(57) ABSTRACT

A method of reducing uneven use of the total number of printing elements on a print head in a printer, when selectively using the printing elements to make different size color image prints on respective similar size receiver mediums, comprises: selectively using the total number of printing elements to make color image prints substantially the same size as the receiver mediums; and selectively using a particular number of printing elements less than the total number of printing elements to make similar size color image prints smaller than the receiver mediums, but alternating which ones of the total number of printing elements can be selectively used to make each print so that the placement of each print on a receiver medium is alternated, whereby, since those printing elements that can be selectively used to make each print smaller than a receiver medium are alternated, uneven use of the printing elements is reduced.

17 Claims, 2 Drawing Sheets

METHOD AND APPARATUS FOR REDUCING UNEVEN USE OF HEATING ELEMENTS ON THERMAL PRINT HEAD

CROSS REFERENCE TO RELATED APPLICATION

Reference is made to commonly assigned, co-pending application Ser. No. 10/274,352, entitled METHOD AND APPARATUS FOR REDUCING UNEVEN USE OF HEATING ELEMENTS ON THERMAL PRINT HEAD and filed Oct. 18, 2002 in the names of Robert F. Mindler and Charles S. Christ.

FIELD OF THE INVENTION

The invention relates generally to image printers, and in particular to thermal printers in which the selective use of individual heating or resistive elements on a thermal print head effects a color dye transfer from a dye donor medium to a dye receiver medium to create a color image print on the dye receiver medium. More specifically, the invention provides a method and corresponding apparatus for reducing uneven use of the heating elements on the thermal print head.

BACKGROUND OF THE INVENTION

A typical dye donor web that is used in a thermal printer includes a repeating series of three different primary color sections or patches such as a yellow color section, a magenta color section and a cyan color section. Also, there may be a transparent laminating section after the cyan color section.

To make a color image print using a thermal printer, respective color dyes in a single series of yellow, magenta and cyan color sections on a dye donor web are successively heat-transferred (e.g. by diffusion), one on top of the other, onto a dye receiver sheet. Then, optionally, the transparent laminating section is deposited on the color image print. The dye transfer from each color section to the dye receiver sheet is done one line of pixels at a time across the color section via a bead of selectively used heating or resistor elements on a thermal print head. The bead of heating elements makes line contact across the entire width of the dye donor web, but only those heating elements that are actually used for a particular line are heated sufficiently to effect a color dye transfer to the receiver sheet. The temperature to which a heating element is heated is proportional to the density (darkness) level of the corresponding pixel formed on the receiver sheet. The higher the temperature of the heating element, the greater the density level of the corresponding pixel. Various modes for raising the temperature of the heating element are described in prior art U.S. Pat. No. 4,745,413 issued May 17, 1988.

One example of a color print-making process using a thermal printer is as follows.

1. A dye donor web and a dye receiver sheet are advanced forward in unison, with a yellow color section of the donor web moving in contact with the receiver sheet longitudinally over a stationary bead of heating elements in order to effect a line-by-line yellow dye transfer from the yellow color section to the receiver sheet. A web take-up spool draws the dye donor web forward over the bead of heating elements, and a pair of pinch and drive rollers draw the dye receiver sheet forward over the bead of heating elements. A platen roller holds the dye receiver sheet in a dye receiving relation with the dye donor web at the bead of heating elements.

2. Once the yellow dye transfer is completed, the platen roller is retracted from adjacent the print head to allow the pair of pinch and drive rollers to return the dye receiver sheet rearward in preparation for a second pass over the bead of heating elements.

3. Then, the platen roller is returned to adjacent the print head, and the dye donor web and the dye receiver sheet are advanced forward in unison, with a magenta color section of the donor web moving in contact with the receiver sheet longitudinally over the bead of heating elements in order to effect a line-by-line magenta dye transfer from the magenta color section to the receiver sheet. The magenta dye transfer to the dye receiver sheet is in exactly the same area on the receiver sheet as was subjected to the yellow dye transfer.

4. Once the magenta dye transfer is completed, the platen roller is retracted from adjacent the print head to allow the pair of pinch and drive rollers to return the dye receiver sheet rearward in preparation for a third pass over the bead of heating elements.

5. Then, the platen roller is returned to adjacent the print head, and the dye donor web and the dye receiver sheet are advanced forward in unison, with a cyan color section of the donor web moving in contact with the receiver sheet longitudinally over the bead of heating elements in order to effect a line-by-line cyan dye transfer from the magenta color section to the receiver sheet. The cyan dye transfer to the dye receiver sheet is in exactly the same area on the receiver sheet as was subjected to the yellow and magenta dye transfers.

6. Once the cyan dye transfer is completed, the platen roller is retracted from adjacent the print head to allow the dye receiver sheet to be returned rearward in preparation for exiting the printer.

7. Then, the pair of pinch and drive rollers advance the dye receiver sheet forward to an exit tray.

When printing a 5×7 inch color image on a 6×8 inch dye receiver sheet, for example, a number of the heating elements closest to the opposite ends of the bead of heating elements are not selectively used, i.e. the heating elements closest to the opposite ends of the line are not selectively heated during the yellow, magenta and cyan dye transfers to the receiver sheet. This leaves a pair of 0.5 inch non-image (white) margin areas along opposite sides of the 5×7 inch color image print on the 6×8 inch receiver sheet. Alternatively, when printing a 6×8 inch color image (instead of a 5×7 inch image) on the 6×8 inch receiver sheet, the heating elements closest to the opposite ends of the bead of heating elements are selectively used, i.e. they are selectively heated during the yellow, magenta and cyan dye transfers to the receiver sheet. As a result, a color image print without any non-image margin areas, i.e. a borderless print, is formed. If the heating elements closest to the opposite ends of the bead of heating elements are used less often than the remainder of the heating elements along the bead, there can result an uneven deterioration between the two which causes the resistance values of the two to become materially different over time. Then, when printing the 6×8 inch color image, the material difference in the resistance values between a less-often-used heating element and an adjacent more-often-used heating element causes a corresponding difference in the density (darkness) levels of the dye transfer effected by the less-often-used heating element and the adjacent more-often-used heating element. As a result, an undesirable printing artifact appears as a white or gray line along the printed 6×8 inch color image. This can make the color image print unacceptable.

SUMMARY OF THE INVENTION

According to one aspect of the invention, a method of reducing uneven use of the total number of printing elements on a print head in a printer, when selectively using the printing elements to make different size color image prints on respective similar size receiver mediums, comprises:

selectively using the total number of printing elements to make color image prints substantially the same size as the receiver mediums; and selectively using a particular number of printing elements less than the total number of printing elements to make similar size color image prints smaller than the receiver mediums, but alternating which ones of the total number of printing elements can be selectively used to make each print so that the placement of each print on a receiver medium is alternated, whereby, since those printing elements that can be selectively used to make each print smaller than a receiver medium are alternated, uneven use of the printing elements is reduced.

According to another aspect of the invention an apparatus is provided for accomplishing each of the method steps.

DETAILED DESCRIPTION OF THE INVENTION

The invention is disclosed as being embodied preferably in a thermal printer in which the selective use, i.e. selective heating, of individual heating or resistive elements on a thermal print head effects a color dye transfer from a dye donor medium to a dye receiver medium to create a color image on the dye receiver medium. One example of such a printer is described in the "BACKGROUND OF THE INVENTION" and in prior art U.S. Pat. No. 4,745,413 issued May 17, 1988. The prior art patent is incorporated in the description of the invention which follows.

Because the features of a thermal printer are generally known, the description which follows is directed in particular only to those elements forming part of or cooperating directly with the invention. It is to be understood, however, that other elements not disclosed may take various forms known to a person of ordinary skill in the art.

Figure 1:
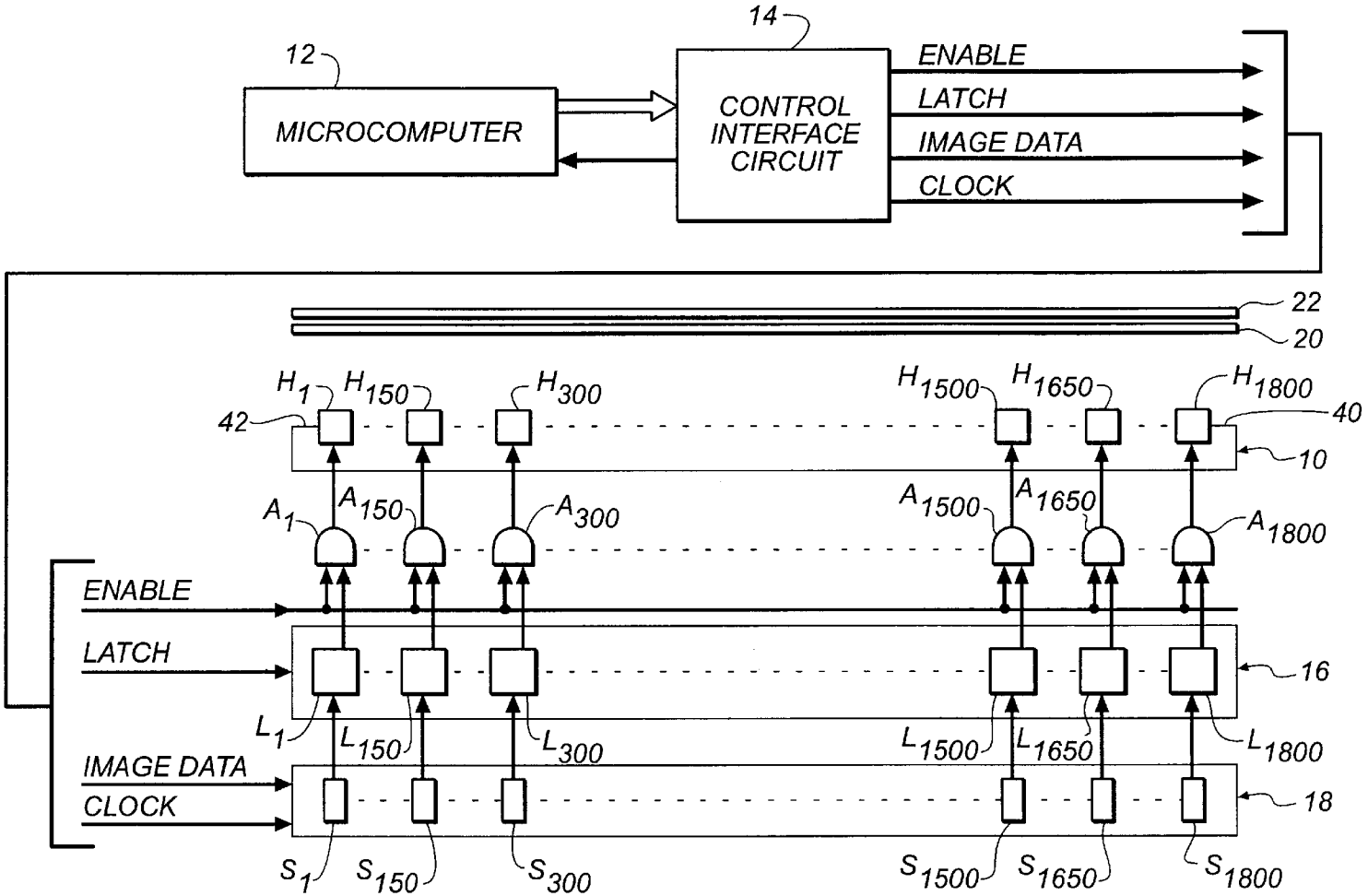
FIG. 1 is a schematic block diagram of a printer control assembly for a bead of heating elements on a print head in a thermal printer.

Referring now to the drawings, FIG. 1 is a schematic block diagram of a printer control assembly for a bead of 1800 heating or resistor elements $H_1$, $H_2$, $H_3$, $H_4$, $H_5$, $H_6$, . . . , $H_{1800}$ arranged in a straight line on a thermal print head 10 in a thermal printer.

The printer control assembly is similar in many respects to one shown in incorporated U.S. Pat. No. 4,745,413 and includes:

a suitably programmed microcomputer 12;

a control interface circuit 14 a series of 1800 AND gates $A_1$–$A_{1800}$;

a latch register 16 having a series of 1800 latch stages $L_1$–$L_{1800}$; and a shift register 18 having 1800 serial shift stages $S_1$–$S_{1800}$.

As described in incorporated U.S. Pat. No. 4,745,413, the control interface circuit 14 under the programmed direction of the microcomputer 12 provides an ENABLE signal to the AND gates $A_1$–$A_{1800}$, a LATCH signal to the latch register 16, and IMAGE DATA and CLOCK signals to the shift register 18. The IMAGE DATA signal is loaded, based on the CLOCK signal, as a serial data stream of binary $1^{'s}$ (highs) and $0^{'s}$ (lows) into the shift register 18 until all of the serial shift register stages $S_1$–$S_{1800}$ have the image data, i.e. a "1" or a "0" at each one of the shift register stages. When the image data has been completely loaded into the shift register 18, the LATCH signal causes the image data in each shift register stage $S_1$–$S_{1800}$ to be latched at the latch stages $L_1$–$L_{1800}$ in order to temporarily save the image data. The latched data then serves to determine whether each one of the heating elements $H_1$–$H_{1800}$ in the print head 10 is to be used or not used, i.e. is energized (ON) or not energized (OFF) to be heated or not heated. The ENABLE signal causes the latched data to be gated at the AND gates $A_1$–$A_{1800}$ to energize or not energize each one of the heating elements $H_1$–$H_{1800}$. In other words, a "1" loaded into the shift register stage $S_1$ and latched at the latch stage $L_1$ causes the heating element $H_1$ to be energized (ON) when the AND gate $A_1$ is enabled. Conversely, a 0" loaded into the shift register stage $S_1$ and then latched at the latch stage $L_1$ permits the heating element $H_1$ to remain not energized (OFF) when the AND gate $A_1$ is enabled. This is commonplace in known thermal heaters. See incorporated U.S. Pat. No. 4,745,413.

To make a color image print, the respective color dyes in a single series of yellow, magenta and cyan color sections on a dye donor web 20 are successively heat-transferred (e.g. by diffusion), one on top of the other, onto a dye receiver sheet 22 which, as is typical, is white. The dye transfer from each color section to the dye receiver sheet 22 is done one line of pixels at a time across the color section via the bead of 1800 heating elements $H_1$–$H_{1800}$ on the thermal print head 10. See FIG. 1. The heating elements $H_1$–$H_{1800}$ make line contact across the entire width of the dye donor web 20, but only those heating elements that are actually used for a particular line are energized to be heated to effect a color dye transfer to the receiver sheet 22 When any one of the heating elements $H_1$–$H_{1800}$, is energized, the temperature to which it is heated must be high enough so that the color dye transfer to the receiver sheet 22 causes the corresponding pixel to have the desired density (darkness) level. The temperature of the heating element can be raised to increase the magnitude of the color dye transfer in order to obtain the desired color density level for the corresponding pixel. As described in incorporated U.S. Pat. No. 4,745,413, this can be done by a pulse width modulation or pulse count modulation of the heating element. According to the pulse width modulation mode, a single constant current pulse is applied to the heating element for a variable time, controlled by the ENABLE signal, in order to vary the time the heating element is energized to effect a color dye transfer to the receiver sheet 22—depending on the desired density level for the corresponding pixel. According to the pulse count modulation mode, a variable number of constant current pulses are applied to the heating element, controlled by the number of times an IMAGE DATA signal is loaded into the shift register 18, in order to vary the number of times the heating element is energized to effect a color dye transfer to the receiver sheet 22—depending on the desired density level for the corresponding pixel. If as we assume, as in incorporated U.S. Pat. No. 4,745,413, there are N possible dye density levels, an IMAGE DATA signal is loaded into the shift register 18 the same number of times, so that the heating element can be energized N different times depending on the desired density level for the corresponding pixel. Each time an IMAGE DATA signal is loaded into the shift register 18, the serial data stream of binary 1's (highs) and 0's (lows) is typically different to vary the density level from pixel to pixel along one line.

By way of example, the heating elements $H_1$–$H_{1800}$ can be selectively used, i.e. selectively heated, to make a 5 (width)×7 (length) inch color image print 24 on a larger 6 (width)×8 (length) inch receiver sheet 22 or to make a 6 (width)×8 length) inch color image print 26 on the 6×8 inch receiver sheet.

Figure 2:
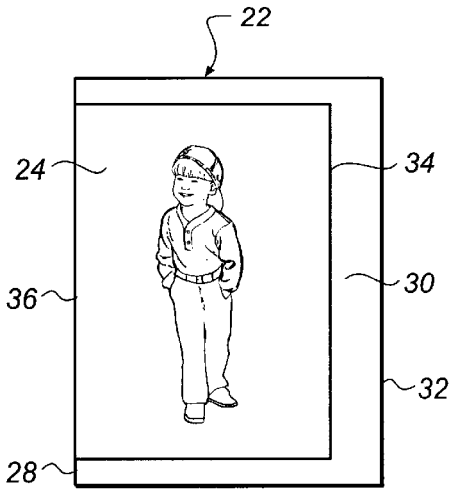
FIGS. 2–4 are illustrations of alternative placements of a 5×7 inch color image print on a 6×8 inch receiver medium, according to a preferred embodiment of the invention.
Figure 3:
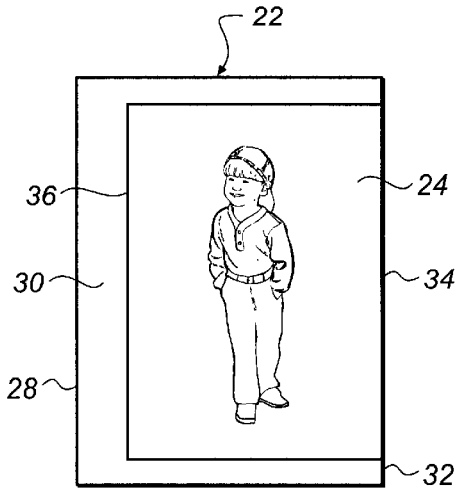
Figure 4:
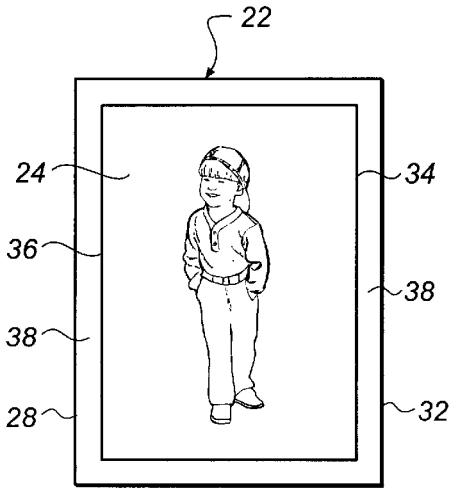

As shown in FIGS. 2–4, the placement of a 5×7 inch color image print 24 on a 6×8 inch receiver sheet 22 can be alternated or varied according to the invention. In FIG. 2, a 5×7 inch color image print 24 is offset leftward on the 6×8 inch receiver sheet 24 to a first side 28 of the receiver sheet so that a 1 inch (width) non-image (white) margin area 30 is left inwardly adjacent a second side 32 of the receiver medium, i.e. along a first side 34 of the color image print. Alternately, in FIG. 3, a 5×7 inch color image print 24 is offset rightward on the 6×8 inch receiver sheet 24 to the second side 32 of the receiver sheet so that a 1 inch (width) non-image (white) margin area 30 is left inwardly adjacent the first side 28 of the receiver medium, i.e. along a second side 36 of the color image print. Alternately, in FIG. 4, a 5×7 inch color image print 24 is centered on the 6×8 inch receiver sheet 22 between the first and second sides 28 and 32 of the receiver sheet so that separate 0.5 inch (width) non-image (white) margin areas 38 are left inwardly adjacent the first and second sides of the receiver medium, i.e. along the first and second sides 34 and 36 of the color image print. Each non-image margin area 30 or 38 along the first and/or second sides 34 and 36 of a 5×7 inch color image print 24 can be manually or automatically trimmed or cropped from the receiver medium (although trimming is not mandatory) using known trimming or cutting means.

Figure 5:
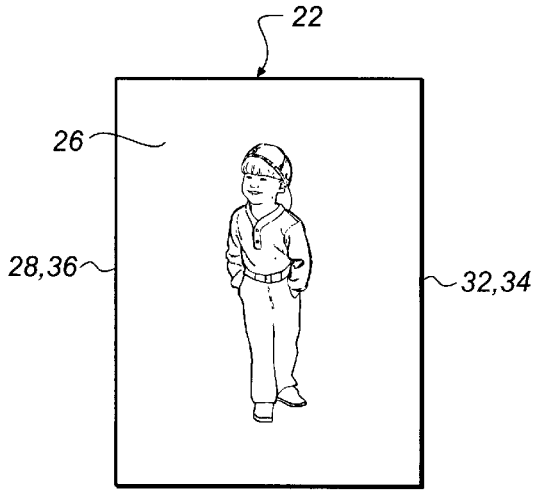
FIG. 5 is an illustration of a 6×8 inch color image print on a 6×8 inch receiver sheet.

On the other hand, when a 6×8 inch color image print 26 is made on the 6×8 inch receiver sheet 22, as in FIG. 5, no non-image margin area is created on the receiver sheet. Thus, the 6×8 inch color image print 26 on the 6×8 inch receiver sheet 22 is a borderless print.

To achieve the alternate placement of a 5×7 inch color image print 24 on a 6×8 inch receiver sheet 22 as in FIGS. 2–4 (as compared with making a 6×8 inch color image print 26 on the 6×8 inch receiver sheet 22 as in FIG. 5) the print-making methodology is as follows, using a pulse count modulation mode.

To place a 5×7 inch color image print 24 on a 6×8 inch receiver sheet 22 as in FIG. 2, digital image data in the form of binary 1's and 0's is inputted from an image data source, such as a work station, into the microcomputer 12. The microcomputer 12, in turn, formulates and processes the digital image data to assemble it in a memory as respective sets or pages of yellow, magenta and cyan image data for the three color dyes in a single series of yellow, magenta and cyan color sections on the dye donor web 20. Within each data set, the image data is stored line-by-line as binary 1's and 0's to be used one line at a time to cause the corresponding color dye to be successively heat-transferred by the heating elements $H_1$–$H_{1800}$ onto the receiver sheet 22. When one line of the yellow image data is transferred to the control interface circuit 14, the interface outputs a first IMAGE DATA signal to be loaded into the shift register 18 as a serial data stream of binary 1's and 0's until all of the serial shift register stages $S_1$–$S_{1800}$ have the image data, i.e. a "1" or a "0" at each one of the shift register stages. The heating elements $H_1$–$H_{1800}$, in turn, are individually energized or not energized, to be heated or not heated. This is done again, successively, with N minus 1 IMAGE DATA signals, each IMAGE DATA signal representing a further stream of binary 1's and 0's, to vary the number of times a heating element is energized, in order to print one line of yellow dye image content as pixels at varying desired density levels on the receiver sheet 22. Once all of the lines of yellow dye image content are printed on the receiver sheet 12, the sequence is repeated line-by-line to print all of the lines of magenta dye image content and then to print all of the lines of cyan dye image content on the receiver sheet 12 (in the same area, i.e. superimposed). Each time an IMAGE DATA signal is loaded into the shift register 18 as a serial data stream of binary 1's and 0's, the shift register stages $S_{1500}$–$S_{1800}$ receive a "0". The remaining shift register stages $S_1$–$S_{1499}$ receive a combination of "1"'s and "O"'s. As a result, the heating elements $H_{1500}$–$H_{1800}$, i.e. the ones closest to a first end 40 of the line of the heating elements $H_1$–$H_{1800}$, are not to be selectively used, i.e. they cannot be selectively energized or not energized to be heated or not heated. Instead, they all remain not energized during the yellow, magenta and cyan dye transfers to the receiver sheet 22. The remaining heating elements $H_1$–$H_{1499}$, including the heating elements $H_1$–$H_{300}$, i.e. the ones closest to a second end 42 of the line of the heating elements, are selectively used, i.e. they can be selectively energized or not energized to be heated or not heated. Thus, as in FIG. 2, the 5×7 inch color image print 24 is offset leftward on the 6×8 inch receiver sheet 22 to the first side 28 of the receiver sheet so that a 1 inch (width) non-image (white) margin area 30 is left inwardly adjacent the second side 32 of the receiver sheet, i.e. along the first side 34 of the color image print.

To place a 5×7 inch color image print 24 on a 6×8 inch receiver sheet 22 as in FIG. 3, the steps are the same as for FIG. 2, except that each time an IMAGE DATA signal is loaded into the shift register 18 as a serial data stream of binary 1's and 0's, the shift register stages $S_1$–$S_{300}$ (instead of $S_{1500}$–$S_{1800}$) receive a "0". The remaining shift register stages $S_{301}$–$S_{1800}$ receive a combination of "1"'s and "0"3 s. As a result, the heating elements $H_1$–$H_{300}$, i.e. the ones closest to the second end 42 of the line of the heating elements $H_1$–$H_{1800}$, are not to be selectively used, i.e. they cannot be selectively energized or not energized to be heated or not heated. Instead, they all remain not energized during the yellow, magenta and cyan dye transfers to the receiver sheet 22. The remaining heating elements $H_{301}$–$H_{1800}$, including the heating elements $H_{1500}$–$H_{1800}$, i.e. the ones closest to the first end 40 of the line of the heating elements, are selectively used, i.e. they can be selectively energized or not energized to be heated or not heated. Thus, as in FIG. 3, the 5×7 inch color image print 24 is offset rightward on the 6×8 inch receiver sheet 22 to the second side 32 of the receiver sheet so that a 1 inch (width) non-image (white) margin area 30 is left inwardly adjacent the first side 28 of the receiver sheet, i.e. along the second side 36 of the color image print.

To place a 5×7 inch color image print 24 on a 6×8 inch receiver sheet 22 as in FIG. 4, the steps are the same as for FIG. 2, except that each time an IMAGE DATA signal is loaded into the shift register 18 as a serial data stream of binary 1's and 0's, both the shift register stages $S_1$–$S_{150}$ and $S_{1650}$–S 1800 receive a "0". The remaining shift register stages $S_{151}$–$S_{1649}$ receive a combination of"1"'s and "0"'s. As a result, the heating elements $H_1$–$H_{150}$ and $H_{1650}$–$H_{1800}$, are not to be selectively used, i.e. they cannot be selectively energized or not energized to be heated or not heated. Instead, they all remain not energized during the yellow, magenta and cyan dye transfers to the receiver sheet 22. The remaining heating elements $H_{151}$–$H_{1649}$ are selectively used, i.e. they can be selectively energized or not energized to be heated or not heated. Thus, as in FIG. 4, the 5×7 inch color image print 24 is centered on the 6×8 inch receiver sheet 22 between the first and second sides 28 and 32 of the receiver sheet so that separate 0.5 inch (width) non-image (white) margin areas 38 are left inwardly adjacent the first and second sides of the receiver sheet, i.e. along the first and second sides 34 and 36 of the color image print.

The microcomputer 12 is programmed, using known programming techniques, to automatically alternate the placement of each 5×7 inch color image print 24 on a receiver sheet 22 as in FIGS. 2–4. In other words, the microcomputer 12 is programmed to alternate which of the shift register stages $S_{1500}$–$S_{1800}$, $S_1$–$S_{300}$, or $S_1$–$S_{150}$ and $S_{1650}$–$S_{1800}$ receive a "0" so that the heating elements $H_{1500}$–$H_{1800}$, $H_1$–$H_{300}$, or $H_1$–$H_{150}$ and $H_{1650}$–$H_{1800}$ cannot be selectively used, i.e. they cannot be selectively energized or not energized to be heated or not heated.

When a 6×8 inch color image print 26 is made on the 6×8 inch receiver sheet 22, as in FIG. 5, the steps are the same as for FIG. 2, except that each time an IMAGE DATA signal is loaded into the shift register 18 as a serial data stream of binary $1^{'s}$ and $0^{'s}$, the shift register stages $S_1$–$S_{1800}$ receive a combination of "1"'s and "0"'s. As a result, all 1800 of the heating elements $H_1$–$H_{1800}$ (as compared to 1500 for FIGS. 2–4) are selectively used, i.e. they can be selectively energized or not energized to be heated or not heated. Thus, as in FIG. 5, no non-image margin area is created on the receiver sheet 22. Instead, the color image print 26 is borderless.

The invention has been described in detail with particular reference to a preferred embodiment thereof, but it will be understood that variations and modifications can be effected within the spirit and scope of the invention.

For example any number of different size color image prints, besides 5×7 inch and 6×8 inch color image prints 24 as in FIGS. 2–5, which are smaller than the receiver medium 22 can be made according to the invention.

Also, all of the heating elements $H_1$–$H_{1800}$, can be initially energized to be heated, but in this instance they are all heated below the respective dye transfer thresholds for the yellow, magenta and cyan dye transfers onto the receiver sheet 22. Then, selected ones of the heating elements are further energized to be heated sufficiently to cause the color dyes to be successively heat-transferred onto the receiver sheet 22.

Also, when there is a transparent laminating section (after the cyan color section) included in each single series of yellow, magenta and cyan color sections on the dye donor web 20, the transparent laminating section can be deposited on the 5×7 inch color image print 24 or the 6×8 inch color image print 26. Preferably, the transparent laminating section is always deposited on the 6×8 receiver sheet 22 from its first side 28 to its second side 32. Alternatively, when making the 5×7 inch color image print 24, the transparent laminating section can be deposited only on the color image print (rather than on the 6×8 receiver sheet 22 from its first side 28 to its second side 32).

PARTS LIST

| | |
|---|---|
| 10. | print head |
| $H_1, H_2, H_3, H_4, H_5, H_6, \ldots, H_{1800}$. | heating elements |
| 12. | microcomputer |
| 14. | control interface circuit |
| $A_1$–$A_{1800}$. | AND gates |

-continued

PARTS LIST

| | |
|---|---|
| 16. | latch register |
| $L_1$–$L_{1800}$. | latch stages |
| 18. | shift register |
| $S_1$–$S_{1800}$. | serial shift stages |
| 20. | dye donor web |
| 22. | dye receiver sheet |
| 24. | color image print |
| 26. | color image print |
| 28. | first side of receiver sheet |
| 30. | non-image margin area |
| 32. | second side of receiver sheet |
| 34. | first side of color image print |
| 36. | second side of color image print |
| 38. | non-image margin area |
| 40. | first end of the line of the heating elements |
| 42. | second end of the line of the heating elements |

What is claimed is:

1. A method of reducing uneven use of the total number of printing elements on a print head in a printer, when selectively using the printing elements to make different size color image prints on respective similar size receiver mediums, said method comprising:

selectively using the total number of printing elements to make color image prints substantially the same size as the receiver mediums; and selectively using a particular number of printing elements less than the total number of printing elements to make similar size color image prints smaller than the receiver mediums, but alternating which ones of the total number of printing elements can be selectively used to make each print so that the placement of each print on a receiver medium is alternated, whereby, since those printing elements that can be selectively used to make each print smaller than a receiver medium are alternated, uneven use of the printing elements is reduced.

2. A method as recited in claim 1, wherein the printing elements to be selectively used to make similar size color image prints smaller than the receiver mediums are alternated to make one print offset on a receiver medium to a first side of the receiver medium so that a non-image margin area is left inwardly adjacent a second side of the receiver medium and to make another print offset on a receiver medium to the second side of the receiver medium so that a non-image margin area is left inwardly adjacent the first side of the receiver medium.

3. A method as recited in claim 2, wherein the printing elements to be selectively used to make color image prints substantially the same size as the receiver mediums make borderless prints so that a non-image area is not left inwardly adjacent either side of a receiver medium.

4. A method as recited in claim 1, wherein the printing elements to be selectively used to make similar size color image prints smaller than the receiver mediums are alternated to make one print offset on a receiver medium to a first side of the receiver medium so that a non-image margin area is left inwardly adjacent a second side of the receiver medium, to make another print offset on a receiver medium to the second side of the receiver medium so that a non-image margin area is left inwardly adjacent the first side of the receiver medium, and to make another print centered on a receiver medium between the first and second sides of the receiver medium so that separate non-image areas are left inwardly adjacent both sides of the receiver medium.

5. A method as recited in claim 1, wherein the total number of printing elements are arranged in a line on the print head, and the printing elements to be selectively used to make similar size color image prints smaller than the receiver mediums are alternated by including those printing elements closest to a first end of the line to make one print, but not including those printing elements closest to a second end of the line, so that the print is offset on a receiver medium to a first side of the receiver medium and a non-image margin area is left inwardly adjacent a second side of the receiver medium, and by including those printing elements closest to the second end of the line to make another print, but not including those printing elements closest to the first end of the line, so that the print is offset on a receiver medium to the second side of the receiver medium and a non-image margin area is left inwardly adjacent the first side of the receiver medium.

6. A method as recited in claim 5, wherein the printing elements to be selectively used to make similar size color image prints smaller than the receiver mediums are alternated also by not including those printing elements closest to the first and second ends of the line so that a print is centered on a receiver medium between the first and sides of the receiver medium and separate non-image margin areas are left inwardly adjacent both sides of the receiver medium.

7. A method as recited in claim 6, wherein a non-margin area inwardly adjacent the first and/or second sides of a receiver medium is trimmed from the receiver medium.

8. A method of reducing uneven use of the total number of heating elements on a print head in a thermal printer, when selectively using the heating elements to make at least two different size color image prints on respective similar size receiver mediums, said method comprising:

alternating which ones of the total number of heating elements can be selectively used, to make similar size color image prints smaller than the receiver mediums and offset on the receiver mediums alternately to opposite first and second sides of the receiver mediums so that a non-image margin area will be left inwardly adjacent the second or first side of a receiver medium; and selectively using the total number of heating elements to make a color image print substantially the same size as a receiver medium so that a non-image margin area is not left inwardly adjacent either side of the receiver medium.

9. A method of reducing uneven use of the total number of heating elements on a print head in a thermal printer, when selectively using the heating elements to make at least two different size color image prints on respective similar size receiver mediums, said method comprising:

alternating which ones of the total number of heating elements can be selectively used, to make similar size color image prints smaller than the receiver mediums and offset on the receiver mediums alternately to opposite first and second sides of the receiver mediums so that a non-image margin area will be left inwardly adjacent either side of a receiver medium, and to make similar size color image prints smaller than the receiver mediums and centered between both sides of the receiver mediums so that a non-margin area will be left inwardly adjacent both sides of a receiver medium; and selectively using the total number of heating elements to make a color image print substantially the same size as a receiver medium so that a non-image margin area is not left inwardly adjacent either side of the receiver medium.

10. A method of reducing uneven use of the total number of heating elements arranged in a line on a thermal print head, when selectively using the heating elements to make different size color image prints on respective similar size receiver mediums, said method comprising:

selectively using less than the total number of heating elements to make a color image print smaller than a receiver medium, including selectively using those heating elements closest to a first end of the line, but not using those heating elements closest to a second end of the line;

selectively using less than the total number of heating elements to make a color image print smaller than a receiver medium, including selectively using those heating elements closest to the second end of the line, but not using those heating elements closest to the first end of the line; and selectively using the total number of heating elements to make a color image print substantially the same size as a receiver medium, whereby, when making successive color image prints smaller than the receiver mediums, the heating elements closest to the respective ends of the line are alternately used to reduce uneven use of the heating elements.

11. A method of reducing uneven use of the total number of heating elements arranged in a line on a thermal print head, when selectively using the heating elements to make different size color image prints on respective similar size receiver mediums, said method comprising:

selectively using a particular number of heating elements less than the total number to make a color image print smaller than a receiver medium, including selectively using those heating elements closest to a first end of the line, but not using those heating elements closest to a second end of the line, so that a non-image margin area is left on the receiver medium along a first side of the color image print;

trimming the non-image margin area along a first side of a color image print from a receiver medium;

selectively using the particular number of the heating elements to make a color image print smaller than a receiver medium, including selectively using those heating elements closest to the second end of the line, but not using those heating elements closest to the first end of the line so that a non-image margin area is left on the receiver medium along a second side of the color image print;

trimming the non-image margin area along a second side of a color image print from a receiver medium; and selectively using the total number of heating elements to make a color image print substantially the same size as a receiver medium so that no non-image margin area is left on the receiver medium along either side of the color image print, whereby, when making successive color image prints smaller than the receiver mediums, the heating elements closest to the respective ends of the line are alternately used to reduce uneven use of the heating elements.

12. A method of reducing uneven use of a total number of heating elements arranged in a line on a thermal print head, when selectively using the heating elements to make different size color image prints on respective similar size receiver mediums, said method comprising:

selectively using a particular number of heating elements less than the total number to make a color image print smaller than a receiver medium, including selectively using those heating elements closest to a first end of the line, but not using those heating elements closest to a second end of the line so that a non-image margin area is left on the receiver medium along a first side of the color image print and not along a second side of the color image print;

selectively using the particular number of heating elements to make a color image print smaller than a receiver medium, including selectively using those heating elements closest to the second end of the line, but not using those heating elements closest to the first end of the line so that a non-image margin area is left on the receiver medium along the second side of the color image print and not along the first side of the color image print;

selectively using the particular number of heating elements to make a color image print smaller than a receiver medium, but not using those heating elements closest to both ends of the line so that respective non-image margin areas are left on the receiver medium along both sides of the color image print; and selectively using the total number of heating elements to make a color image print substantially the same size as a receiver medium so that no non-image margin area is left on the receiver medium along either side of the color image print, whereby, when making successive color image prints smaller than the receiver mediums, the heating elements closest to the respective ends of the line are alternately used to reduce uneven use of the heating elements.

13. A method as recited in claim 12, wherein a non-image margin area along the first and/or second sides of a color image print is trimmed from a receiver medium.

14. An apparatus for reducing uneven use of the total number of printing elements on a print head in a printer, when selectively using said printing elements to make different size color image prints on respective similar size receiver mediums, said apparatus comprising:

means for selectively using the total number of printing elements to make color image prints substantially the same size as the receiver mediums; and means for selectively using a particular number of printing elements less than the total number of printing elements to make similar size color image prints smaller than the receiver mediums, but alternating which ones of the total number of printing elements can be selectively used to make each print so that the placement of each print on a receiver medium is alternated, whereby, since those printing elements that can be selectively used to make each print smaller than a receiver medium are alternated, uneven use of said printing elements is reduced.

15. Apparatus as recited in claim 14, wherein said means for selectively using a particular number of printing elements less than the total number of printing elements to make similar size color image prints smaller than the receiver mediums alternates said printing elements to make one print offset on a receiver medium to a first side of the receiver medium so that a non-image margin area is left inwardly adjacent a second side of the receiver medium and to make another print offset on a receiver medium to the second side of the receiver medium so that a non-image margin area is left inwardly adjacent the first side of the receiver medium.

16. An apparatus for reducing uneven use of the total number of heating elements on a print head in a thermal printer, when selectively using said heating elements to make at least two different size color image prints on respective similar size receiver mediums, said apparatus comprising:

means for alternating which ones of the total number of heating elements can be selectively used, to make similar size color image prints smaller than the receiver mediums and offset on the receiver mediums alternately to opposite first and second sides of the receiver mediums so that a non-image margin area will be left inwardly adjacent the second or first side of a receiver medium; and means for selectively using the total number of heating elements to make a color image print substantially the same size as a receiver medium so that a non-image margin area is not left inwardly adjacent either side of the receiver medium.

17. An apparatus for reducing uneven use of a total number of heating elements arranged in a line on a thermal print head, when selectively using the heating elements to make different size color image prints on respective similar size receiver mediums, said apparatus comprising:

means for selectively using a particular number of heating elements less than the total number to make a color image print smaller than a receiver medium, including selectively using those heating elements closest to a first end of the line, but not using those heating elements closest to a second end of the line so that a non-image margin area is left on the receiver medium along a first side of the color image print and not along a second side of the color image print;

means for selectively using the particular number of heating elements to make a color image print smaller than a receiver medium, including selectively using those heating elements closest to the second end of the line, but not using those heating elements closest to the first end of the line so that a non-image margin area is left on the receiver medium along the second side of the color image print and not along the first side of the color image print;

means for selectively using the particular number of heating elements to make a color image print smaller than a receiver medium, but not using those heating elements closest to both ends of the line so that respective non-image margin areas are left on the receiver medium along both sides of the color image print; and means for selectively using the total number of heating elements to make a color image print substantially the same size as a receiver medium so that no non-image margin area is left on the receiver medium along either side of the color image print, whereby, when making successive color image prints smaller than the receiver mediums, said heating elements closest to the respective ends of the line are alternately used to reduce uneven use of said heating elements.

* * * * *